US006498907B2

(12) United States Patent
Yoda

(10) Patent No.: US 6,498,907 B2
(45) Date of Patent: Dec. 24, 2002

(54) IMAGE FORMING APPARATUS INCLUDING TRANSFER MEANS WITH TRANSFER BIAS OUTPUT CONTROLLED BY CALCULATED IMPEDANCE AT PREDETERMINED VOLTAGE/CURRENT

(75) Inventor: Yasuo Yoda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/820,885

(22) Filed: Mar. 30, 2001

(65) Prior Publication Data

US 2001/0028803 A1 Oct. 11, 2001

(30) Foreign Application Priority Data

Mar. 31, 2000 (JP) ..... 2000-096296

(51) Int. Cl.[7] ..... G03G 15/00; G03G 15/16
(52) U.S. Cl. ..... 399/44; 399/66
(58) Field of Search ..... 399/44, 45, 66

(56) References Cited

U.S. PATENT DOCUMENTS 5,999,760 A * 12/1999 Suzuki et al. ..... 399/45

* cited by examiner

*Primary Examiner*—Joan Pendegrass
(74) *Attorney, Agent, or Firm*—Fitzpatrick, Cella, Harper & Scinto

(57) ABSTRACT

An image forming apparatus includes an image bearing member for bearing a developer image, a transfer member for electrostatically transferring the developer image onto a transfer material, a power supply for applying a voltage to the transfer member, and an electric current detector for detecting a value of an electric current which flows to the transfer member when the voltage is applied from the power supply to the transfer member. The image forming apparatus controls an output of the power supply by varying the voltage applied to the transfer member by a predetermined voltage quantity in such a manner that the electric current value detected by the electric current detector becomes a target electric current value. The predetermined voltage quantity can be varied.

24 Claims, 12 Drawing Sheets

FIG.2

| VOLTAGE VARIABLE QUANTITY [V] | | | | | | |
|---|---|---|---|---|---|---|
| TEMPERATURE [°C] / HUMIDITY [%R.H.] | TO 15 | 15 TO 20 | 20 TO 25 | 25 TO 30 | 30 TO 35 | FROM 35 |
| 0 TO 20 | 50 | 50 | 50 | 40 | 40 | 30 |
| 20 TO 40 | 50 | 50 | 40 | 30 | 20 | 20 |
| 40 TO 60 | 40 | 30 | 20 | 20 | 20 | 10 |
| 60 TO 80 | 30 | 20 | 20 | 10 | 10 | 10 |
| 80 TO 100 | 20 | 10 | 10 | 10 | 10 | 10 |

FIG.4

| LEVEL OF BLANK AREA CAUSED BY POOR TRANSFER OF SOLID IMAGE IN LEADING END OF TRANSFER MATERIAL | | |
|---|---|---|
| ENVIRONMENT | EMBODIMENT 1 | CONVENTIONAL EXAMPLE |
| HH | ○ | × |
| JJ | ○ | ○ |
| LL | ○ | × |

○: BLANK AREA DOES NOT OCCUR (DIFFERENCE IN OPTICAL DENSITY BETWEEN LEADING END AND CENTER OF TRANSFER MATERIAL IS LESS THAN 0.3)

△: MINOR BLANK AREA OCCURS (DIFFERENCE IN OPTICAL DENSITY BETWEEN LEADING END AND CENTER OF TRANSFER MATERIAL IS NOT LESS THAN 0.3 AND LESS THAN 0.6)

×: BLANK AREA OCCURS (DIFFERENCE IN OPTICAL DENSITY BETWEEN LEADING END AND CENTER OF TRANSFER MATERIAL IS NOT LESS THAN 0.6)

FIG.9

| SECONDARY TRANSFER IMPEDANCE Z1 [Ω] | VOLTAGE VARIABLE QUANTITY [V] |
|---|---|
| TO 1.7e7 | 10 |
| 1.7e7 TO 3.5e7 | 20 |
| 3.5e7 TO 5.2e7 | 30 |
| 5.2e7 TO 8.0e7 | 40 |
| FROM 8.0e7 | 50 |

IMAGE FORMING APPARATUS INCLUDING TRANSFER MEANS WITH TRANSFER BIAS OUTPUT CONTROLLED BY CALCULATED IMPEDANCE AT PREDETERMINED VOLTAGE/CURRENT

BACKGROUND OF THE INVENTION

1. Field of the Invention

The present invention relates to an image forming apparatus such as a copying machine, a printer, a facsimile machine and the like for performing image formation in accordance with an electrophotographic method or an electrostatic recording method.

2. Related Background Art

As an electrophotographic multi-color or full-color image forming apparatus, there is proposed a so-called tandem type image forming apparatus which forms a color image by arranging a plurality of photosensitive drums in one row and sequentially superimposing a toner image of each color formed on each photosensitive drum onto an intermediate transfer member (intermediate transfer belt) or onto a transfer material.

FIG. 11 is a schematic block diagram showing an example of a conventional electrophotographic tandem type full-color image forming apparatus.

This image forming apparatus is provided with four image forming stations (image forming units), i.e., an image forming station 1Y for forming an image of a yellow color, an image forming station 1M for forming an image of a magenta color, an image forming station 1C for forming an image of a cyan color, and an image forming station 1K for forming an image of a black color, and these four image forming stations are arranged in one row at predetermined intervals.

In each of the image forming stations 1Y, 1M, 1C and 1K, photosensitive drums 2*a*, 2*b*, 2*c* and 2*d* are provided as image bearing members. Around the respective photosensitive drums 2*a*, 2*b*, 2*c* and 2*d* are provided charging rollers 3*a*, 3*b*, 3*c* and 3*d*, developing devices 4*a*, 4*b*, 4*c* and 4*d*, primary transfer rollers 5*a*, 5*b*, 5*c* and 5*d*, and drum cleaning devices (cleaning blades) 6*a*, 6*b*, 6*c* and 6*d*. Further, exposing devices 7*a*, 7*b*, 7*c* and 7*d* are respectively provided above portions between the charging rollers 3*a*, 3*b*, 3*c* and 3*d* and the developing devices 4*a*, 4*b*, 4*c* and 4*d*. Yellow toner, magenta toner, cyan toner and black toner are respectively contained in the respective developing devices 4*a*, 4*b*, 4*c* and 4*d*.

In this conventional example, each of the photosensitive drums 2*a*, 2*b*, 2*c* and 2*d* is a negative charge organic photoconductor and has a photoconductive layer (not shown) on a drum base body (not shown) made of, e.g., aluminum. Each photosensitive drum is driven to rotate at a predetermined process speed by a drive device (not shown).

The charging rollers 3*a*, 3*b*, 3*c* and 3*d* (charging means) are respectively brought into contact with the photosensitive drums 2*a*, 2*b*, 2*c* and 2*d* by a predetermined pressure force and uniformly charge the surfaces of the respective photosensitive drums 2*a*, 2*b*, 2*c* and 2*d* by charging bias applied from a charging bias power supply (not shown) so as to provide a predetermined polarity and potential.

The developing devices 4*a*, 4*b*, 4*c* and 4*d* cause the toner to adhere to electrostatic latent images formed on the respective photosensitive drums 2*a*, 2*b*, 2*c* and 2*d* and develop (realize visible images) them as toner images.

Each of the primary transfer rollers 5*a*, 5*b*, 5*c* and 5*d* (primary transferring means) is constituted by coating a core with an elastic member having a medium-resistance (volume resistivity: $1\times10^4$ to $1\times10^7\Omega$cm), and it comes into contact with each of the photosensitive drums 2*a*, 2*b*, 2*c* and 2*d* through the intermediate transfer belt 8 (an intermediate transfer member) at each primary transfer position. Primary transfer bias power supplies (high-voltage power supplies) 9*a*, 9*b*, 9*c* and 9*d* are respectively connected to the primary transfer rollers 5*a*, 5*b*, 5*c* and 5*d*.

The exposing devices (laser scanner devices) 7*a*, 7*b*, 7*c* and 7*d* form electrostatic latent images according to image information on the surfaces of the respective photosensitive drums 2*a*, 2*b*, 2*c* and 2*d* charged by the respective charging rollers 3*a*, 3*b*, 3*c* and 3*d* by outputting from a laser output section (not shown) laser beams modulated in accordance with time series electric digital pixel signals of image information respectively input from a host computer (not shown) and image-exposing the surfaces of the respective photosensitive drums 2*a*, 2*b*, 2*c* and 2*d* through reflection mirrors 10*a*, 10*b*, 10*c* and 10*d*.

The intermediate transfer belt 8 is stretched around a drive roller 11, a secondary transfer opposite roller 12 and a support roller 13 and rotated (moved) in a direction indicated by an arrow (clockwise direction) by drive of the drive roller 11. The secondary transfer opposite roller 12 is brought into contact with a secondary transfer roller 14 through the intermediate transfer belt 8 to form a secondary transfer position M. As the intermediate transfer belt 8, one having a volume resistivity of $1\times10^8$ to $1\times10^{12}\Omega$cm is preferable, and one consisting of urethane based resin, fluorine-based resin, nylon-based resin or polyimide-based resin, one consisting of an elastic material such as silicone rubber or Hydrin rubber, or one obtained by dispersing carbon or conductive powder in these materials and performing the resistivity adjustment can be used. In this conventional example, a single-layer endless belt having a thickness of 0.1 mm obtained by dispersing carbon in polyimide and adjusting the volume resistivity to $1\times10^9\Omega$cm was used as the intermediate transfer belt 8.

The secondary transfer roller 14 is constituted by coating a core with a foam layer of, e.g., EPDM, NBR, Hydrin rubber having a medium-resistance value (volume resistivity: $1\times10^6$ to $1\times^{10}\Omega$cm) and provided at a position opposed to the secondary transfer opposite roller 12 with the intermediate transfer belt 8 and a transfer material P such as paper sandwiched therebetween so as to be capable of contacting with and being separated from them. Further, to the secondary transfer roller 14 are connected a current detector 17 for applying and controlling the later-described secondary transfer bias, a power supply 18, and a controller 19.

The belt cleaning device (cleaning blade) 15 for removing and collecting transfer residual toner remaining on the surface of the intermediate transfer belt 8 is provided at the outside of the intermediate transfer belt 8. Further, a fixing device 16 having a fixing roller 16*a* and a pressure roller 16*b* is provided downstream of a secondary transfer position M in the direction for conveying the transfer material P where the secondary transfer opposite roller 12 and the secondary transfer roller 14 come into contact with each other.

The image forming operation by the above-described image forming apparatus will now be described.

When an image forming operation start signal is sent, transfer material (paper) P is fed one by one from a cassette (not shown) and conveyed to a registration roller (not shown). At this time, the registration roller (not shown) is stopped and the leading end of the transfer material P is in the standby mode immediately before the secondary transfer position M.

On the other hand, in the respective image forming stations 1Y, 1M, 1C and 1K, when the image forming operation start signal is sent, the respective photosensitive drums 2*a*, 2*b*, 2*c* and 2*d* driven to rotate at a predetermined process speed (0.117 in/see) are uniformly charged so as to have a negative polarity by the charging rollers 3*a*, 3*b*, 3*c* and 3*d*, respectively. The exposing devices 7*a*, 7*b*, 7*c* and 7*d* respectively convert color-separated image signals input from a host computer (not shown) into optical signals in the laser output section (not shown), and the modulated laser beams (the converted optical signals) are respectively scan-exposed through the reflection mirrors 10*a*, 10*b*, 10*c* and 10*d* onto the respective charged photosensitive drums 2*a*, 2*b*, 2*c* and 2*d* so as to form electrostatic latent images thereon.

The intensity and the irradiation spot diameter of each laser beam are appropriately set by using a resolution of the image forming apparatus and a desired image density. The electrostatic latent images on the respective photosensitive drums 2*a*, 2*b*, 2*c* and 2*d* are formed when a portion irradiated with the laser beam is held at a light section potential (−150 V) and a portion irradiated with no laser beam is held at a dark section potential (−550 V) charged by the respective charging rollers 3*a*, 3*b*, 3*c* and 3*d*.

At first, the developing device 4*a* to which developing bias (in this conventional example, bias obtained by superimposing an altenating component (rectangular wave having a peak-to-peak voltage of 1.5 kV and a frequency of 3 kHz on a direct current component (−400 V)) having a polarity equal to the charging polarity (negative polarity) of the photosensitive drum 2*a* causes yellow toner to adhere to the electrostatic latent image formed on the photosensitive drum 2*a*, thereby visualizing it as a toner image. This yellow toner image is primary transferred onto the rotating intermediate transfer belt 8 by the primary transfer roller 5*a* to which the primary transfer bias (having a polarity (positive polarity) opposite to that of the toner) from the primary transfer bias power supply 9*a*.

The intermediate transfer belt 8 onto which the yellow toner image is transferred is moved to the image forming station 1M side. In the image forming station 1M, a toner image of magenta similarly formed on the photosensitive drum 2*b* is superimposed onto the toner image of yellow on the intermediate transfer belt 8 and transferred by the primary transfer roller 5*b* to which the primary transfer bias (bias having a polarity opposite to that of the toner (in this conventional example, +300 V)) from the primary transfer bias power supply 9*b*.

Subsequently, toner images of cyan and black formed on the photosensitive drums 2*c* and 2*d* in the image forming stations 1C and 1K are similarly sequentially superimposed on the toner images of yellow and magenta, which are superimposed and transferred onto the intermediate transfer belt 8, by the primary transfer rollers 5*c* and 5*d* to which a primary transfer bias (bias having a polarity opposite to that of the toner (in this conventional example, +300 V)) is applied from the respective primary transfer bias power supplies 9*c* and 9*d*.

In accordance with the timing at which the full color toner image leading end on the intermediate transfer belt 8 is moved to the secondary transfer position M, the transfer material P is conveyed to the secondary transfer position M by the registration roller (not shown), and the full-color toner image is collectively secondary-transferred onto the transfer material P by the secondary transfer roller 14 on which the secondary transfer bias (bias having a polarity opposite to that of the toner (in this conventional example, +20μA)) is applied.

The transfer material P having the full-color toner image formed thereon is conveyed to the fixing device 16, and the full-color toner image is heated and pressed by a fixing nip between the fixing roller 16*a* and the pressure roller 16*b* so as to be thermally fixed on the transfer material P. Thereafter, the transfer material P is delivered to the outside, thereby terminating a series of the image forming steps.

It is to be noted that the primary transfer residual toner remaining on the photosensitive drums 2*a*, 2*b*, 2*c* and 2*d* is removed and collected by the drum cleaning devices 6*a*, 6*b*, 6*c* and 6*d* at the time of the above-described each primary transfer. Further, the secondary transfer residual toner remaining on the intermediate transfer belt 8 after the secondary transfer is removed and collected by the belt cleaning device 15.

Description will now be given as to the secondary transfer bias control with respect to the secondary transfer roller 14 in this conventional example.

In this conventional example, the electric current detector 17 detects an electric current which flows when a voltage is applied from the power supply 18 to the secondary transfer roller 14 by control of the controller 19. Based on a detection signal input from the current detector 17, the controller 19 controls the transfer electric current by controlling the output voltage of the power supply 18 in such a manner that the detection signal has a predetermined value.

The control of the transfer electric current will now be described with reference to a flowchart shown in FIG. 12.

When a voltage V is applied to the secondary transfer roller 14 upon starting the constant current control (step S1), the electric current detector 17 detects a value of an electric current which flows in response to application of the voltage V, and this value is converted into an analog signal. After being input to the controller 19, this analog signal is subjected to A/D conversion so as to be converted into a detection electric current value i which is a digital value (step S2).

The detection electric current value i obtained in the step S2 is compared with a target electric current value i0 previously stored in the controller 19 (step S3). If a difference Δi (=i0−i) between these values is larger than 0 (0<Δi), a voltage value (step S4) obtained by adding a predetermined voltage variable quantity ΔV to the output voltage V is set. Further, if the difference Δi (=i0−i) is 0 (0=Δi), the output voltage V at that time is held (step S5). Furthermore, if the difference Δi (=i0−i) is smaller than 0 (0>Δi), a voltage value obtained by subtracting a predetermined voltage variable quantity ΔV from the output voltage V is set (step S6).

After making judgment upon whether the above-described constant electric current control is continued or terminated (step S7), if this control is continued, the set voltage value V is applied (step S8), and the processing then returns to the step S2. By repeating the above-described operation, the transfer electric current is converged to a target electric current value, and the electric current control is realized in the power supply 18. As to judgment upon whether the control is continued or terminated (step S7), the control may be terminated upon completion of the transfer operation involved by the image formation, for example. It is to be noted that the target electric current value i0 is +20

μA and the voltage variable quantity ΔV is +20V in this conventional example.

For the meantime, in the above-described image forming apparatus using the constant electric current control, it is known that the following problems occur in the above-mentioned secondary transfer step.

Impedance of a transfer system (path along which the transfer electric current flows from the power supply through the transferring means) varies due to a change in the environment (temperature or humidity) in which the image forming apparatus is provided, a type of the transfer material P, an individual difference of the secondary transfer roller 14 and the like as the transfer member. As a result, in a low-temperature and low-humidity environment LL (for example, a temperature: 15° C. and a humidity: 10%), rising of the power supply 18 becomes slower than that in the ordinary-temperature and ordinary-humidity environment JJ (for example, a temperature of 23° C., a humidity: 60%) because of increase in the resistance of the secondary transfer roller 14. Consequently, convergence to the target electric current value i0 takes time when a sudden fluctuation in load occurs, thereby generating a failure in an image such as a light image due to defective transfer in a leading end area of the transfer material P and the like.

On the other hand, in the high-temperature and high-humidity environment HH (for example, a temperature: 30° C. and a humidity: 80%), rising of the power supply 18 becomes faster than that in the ordinary-temperature and ordinary-humidity environment (for example, a temperature: 23° C. and a humidity: 60%) because of decrease in the resistance of the secondary transfer roller 14. As a result, overshooting or undershooting of the transfer bias occurs when the load suddenly fluctuates, thereby generating a failure of an image such as a light image due to defective transfer in a leading end area of the transfer material P and the like.

SUMMARY OF THE INVENTION

It is, therefore, an object of the present invention to provide an image forming apparatus capable of preventing a failure of an image involved by a change in impedance of a transfer system due to a change in the environment (temperature, humidity), a type of a transfer material, or an individual difference of a transfer member (such as a transfer roller).

To achieve this aim, according to the present invention, there is provided an image forming apparatus capable of changing a predetermined voltage quantity comprising:

- an image bearing member for bearing a developer image;
- transferring means for electrostatically transferring the developer image onto a transfer material;
- a power supply for applying a voltage to the transferring means;
- electric current detecting means for detecting a value of an electric current flowing to the transferring means when a voltage is applied from the power supply to the transferring means; and
- controlling means for controlling an output of the power supply by varying a voltage applied to the transferring means in such a manner that the electric current value detected by the electric current detecting means becomes a predetermined target electric current value.

BRIEF DESCRIPTION OF THE DRAWINGS

FIG. 2 is a view showing a table of the relationship between a result of temperature and humidity detection and a voltage variable quantity ΔV;

FIG. 4 is a view showing a result of comparison evaluation of levels of "blank area caused by poor transfer" in the image forming apparatus according to the embodiment 1 of the present invention and in a conventional image forming apparatus;

FIG. 9 is a view showing a table of the relationship between secondary transfer impedance Z1 and a voltage variable quantity ΔV in an embodiment 2 of the present invention;

DESCRIPTION OF THE PREFERRED EMBODIMENTS

The present invention will now be described hereinafter with reference to illustrative embodiments.

Embodiment 1

Figure 1:
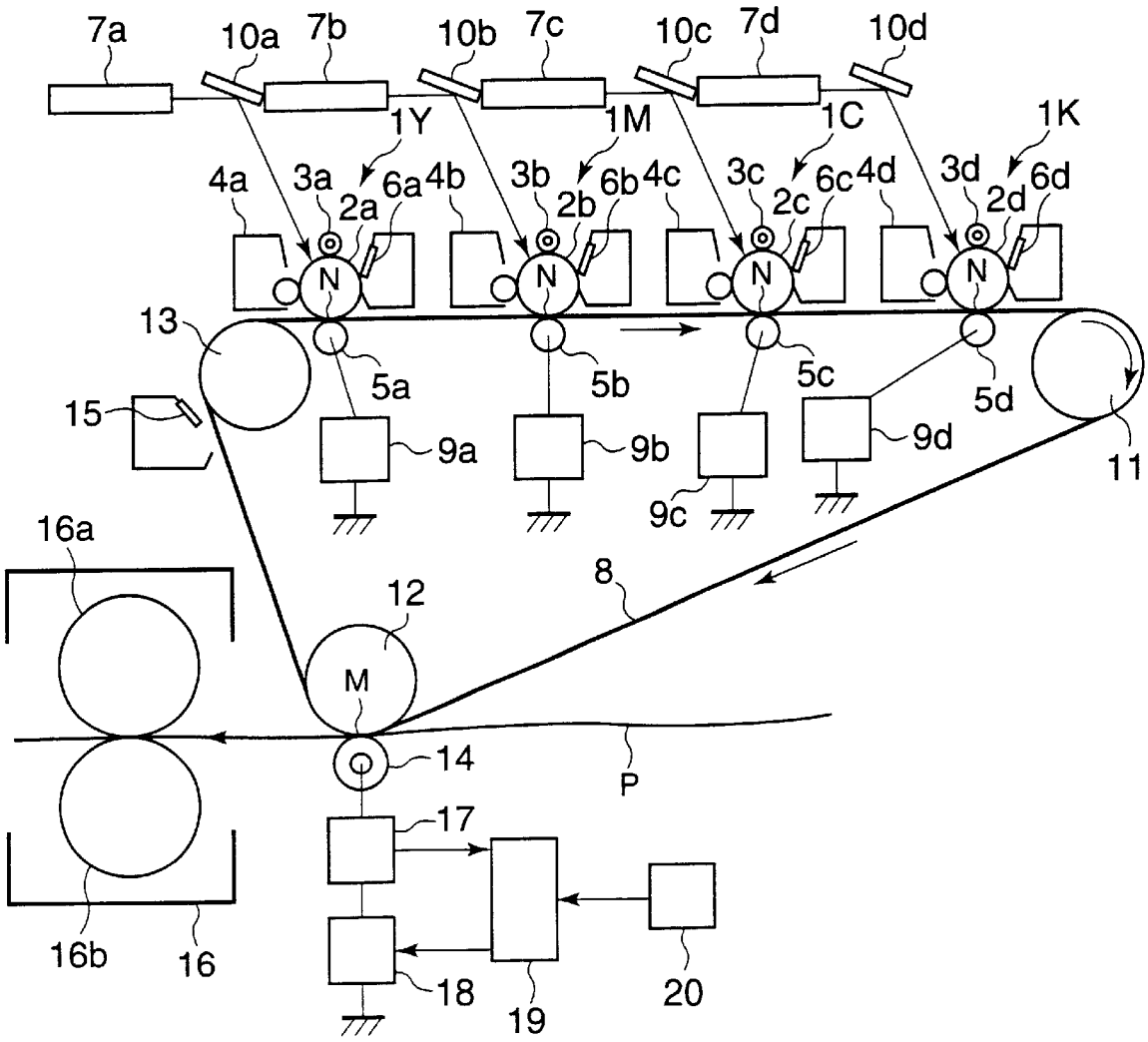
FIG. 1 is a schematic diagram showing an image forming apparatus according to an embodiment 1 of the present invention.
Figure 11:
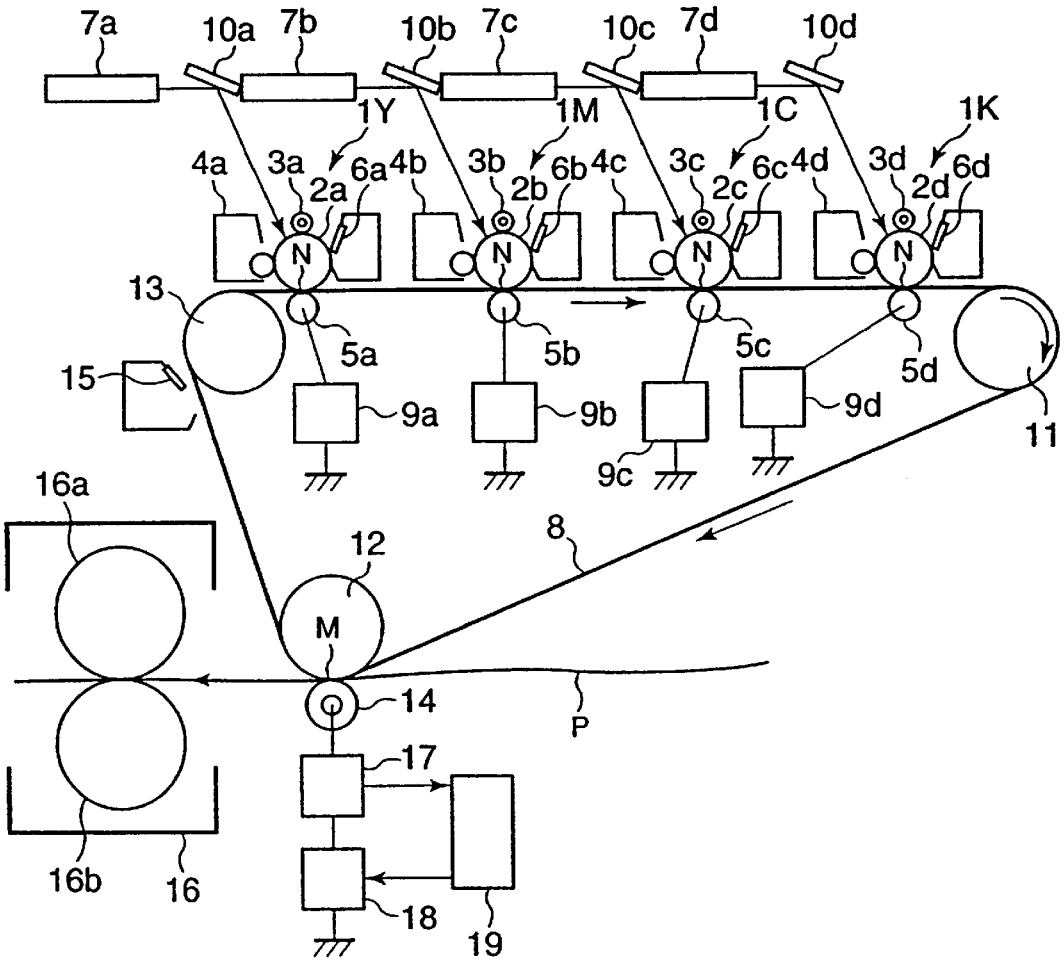
FIG.11 PRIOR ART
FIG. 11 is a schematic diagram showing an image forming apparatus in a conventional art.

FIG. 1 is a schematic diagram showing an image forming apparatus (an electrophotographic tandem type full-color image forming apparatus such as a laser printer in this embodiment) according to an embodiment 1 of the present invention. It is to be noted that like reference numerals denote parts having the same function as that in the conventional image forming apparatus shown in FIG. 11, thereby avoiding the tautological explanation. In this embodiment, the image forming operation is similarly carried out as in the above-described conventional image forming apparatus, thus omitting the description of the image forming operation in this embodiment.

In this embodiment, a hygrothermosensor 20 for detecting hygrothermal information in the image forming apparatus is provided, and the controller 19 sets a voltage variable quantity (predetermined voltage quantity) ΔV at the time of applying a voltage from the power supply 18 to the secondary transfer roller 14 based on the hygrothermal information input from the hygrothermosensor 20. Any other structure is the same as that of the above-described conventional image forming apparatus, and description will be given as to only the secondary transfer bias control applied to the secondary transfer roller 14 in this embodiment.

Since the resistance value of the transfer material P or a transfer-related member (for example, the secondary transfer roller 14) largely depends on a temperature and a humidity in the image forming apparatus and varies, it is possible to presume transfer impedance determined by the resistance value of the transfer material P or the secondary transfer roller 14 from the temperature and the humidity in the image forming apparatus. Therefore, in this embodiment, the relationship between the temperature and humidity in the image forming apparatus and the appropriate voltage variable quantity (predetermined voltage quantity) ΔV is examined by an experiment. The experimental result is previously expressed in the form of a table and stored in a memory (not shown) as storing means, and a value of the voltage variable quantity ΔV according to the temperature and the humidity is selected. FIG. 2 is a view showing the relationship among the temperature, the humidity and an appropriate voltage variable quantity ΔV in the table in this embodiment. It is to be noted that the memory may be provided inside or outside the controller 19.

Further, in this embodiment, a temperature and a humidity in the image forming apparatus are detected by the hygrothermosensor 20, and the controller 19 selects an appropriate voltage variable quantity ΔV according to the temperature and the humidity input from the hygrothermosensor 20 from the table showing the relationship among the temperature, the humidity and the voltage variable quantity ΔV stored in the memory (not shown) and applies the voltage V obtained by adding the selected voltage variable quantity ΔV to the secondary transfer roller 14 to perform the secondary transfer.

Figure 12:
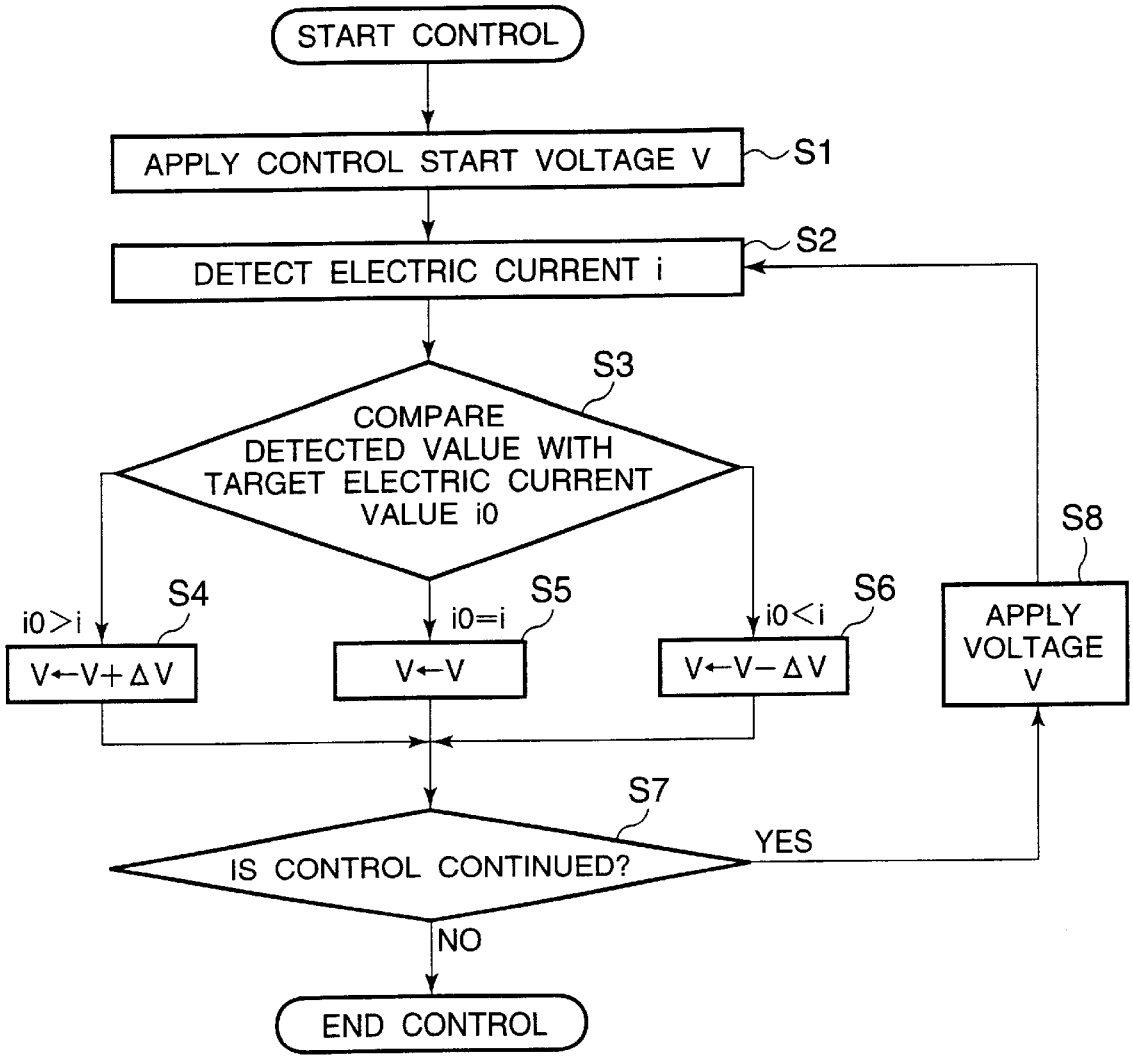
FIG. 12 is a flowchart showing the secondary transfer bias control in the conventional art.

An example of the transfer electric current control in this embodiment will now be described with reference to FIG. 3. The temperature and humidity detecting means first detects the hygrothermal information (S101), and the hygrothermal information is associated with the table shown in FIG. 2 to determine an appropriate predetermined voltage quantity ΔV (S102). In the subsequent S1 to S8, steps similar to S1 to S8 in FIG. 12 are executed.

Furthermore, evaluation was carried out by comparing levels of "blank area caused by poor transfer" obtained when executing image formation by using the image forming apparatus using the secondary transfer bias control (the voltage variable quantity ΔV is changed based on the result of temperature and humidity detection) in this embodiment and the image forming apparatus using the secondary transfer bias control (only one voltage variable quantity ΔV is provided and fixed to 20 V in this example) in the above-described conventional art. Incidentally, it was assumed that the "blank area caused by poor transfer" occurs when an optical density difference between the leading end and the central portion of a sheet of paper (transfer material P) onto which a solid image is transferred is not less than 0.6.

FIG. 4 shows a result of comparison evaluation of levels of "blank area caused by poor transfer⇆ between the image forming apparatus according to this embodiment and the image forming apparatus according to the conventional art. In this connection, the environments in this evaluation were HH (high temperature and high humidity), JJ (ordinary temperature and ordinary humidity) and LL (low temperature and low humidity) and a solid image was output to judge generation of the "blank area caused by poor transfer" at the leading end of the paper sheet based on the density of the solid image. As apparent from the evaluation result, when the voltage variable quantity ΔV was changed in accordance with the temperature and the humidity in the image forming apparatus to select an appropriate value, generation of the "blank area caused by poor transfer" at the leading end of the paper sheet involved due to a change in the temperature and the humidity was suppressed so as to obtain an excellent image. That is because a change in the temperature and the humidity in the image forming apparatus causes the resistance of the paper sheet (transfer material P) or the resistance of the secondary transfer roller 14 to vary, and the optimum voltage variable quantity ΔV is thereby changed.

Figure 5:
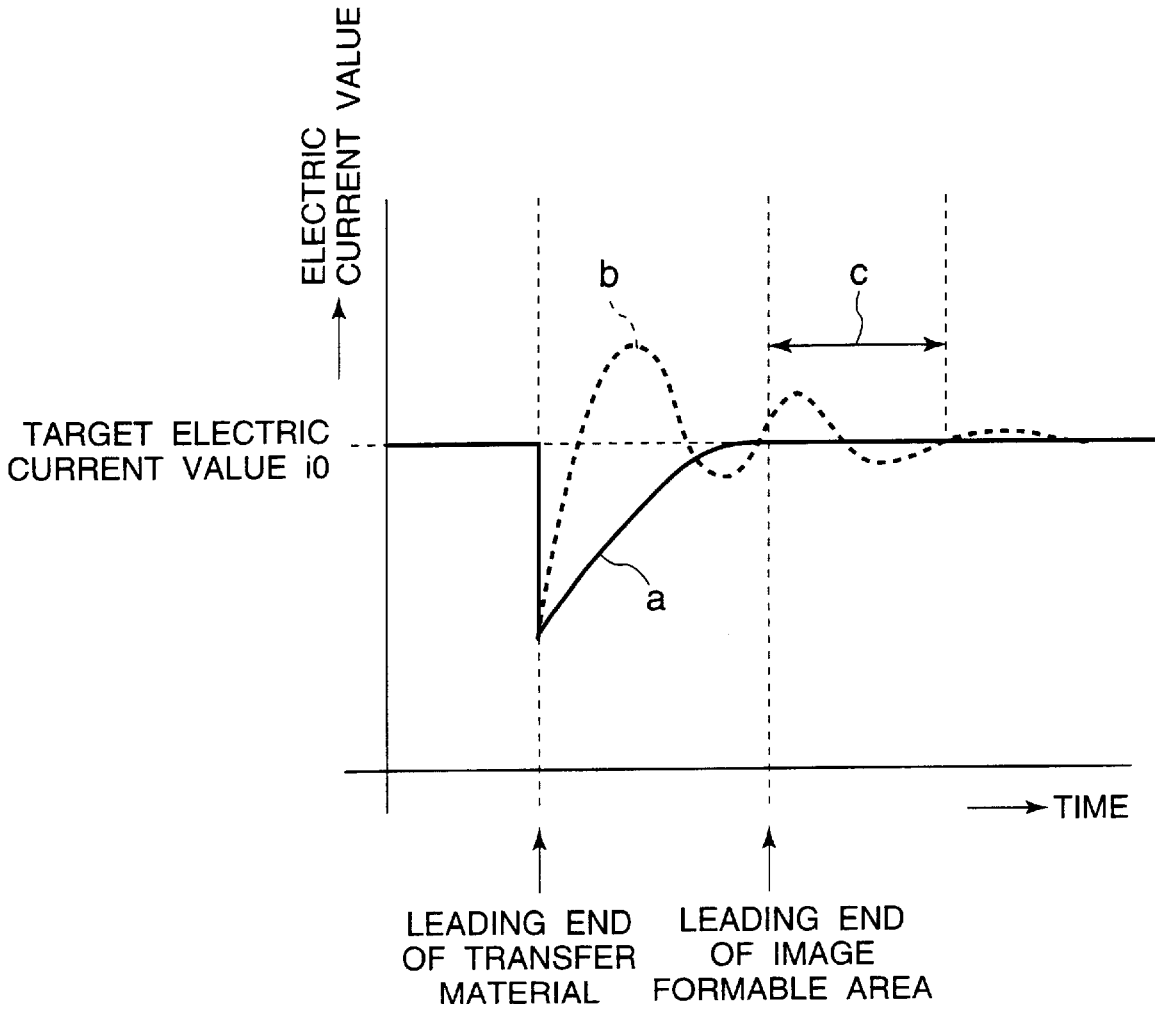
FIG. 5 is a view showing a waveform of a transfer electric current in the vicinity of the timing at which a leading end of a transfer material enters a secondary transfer position M.
Figure 6:
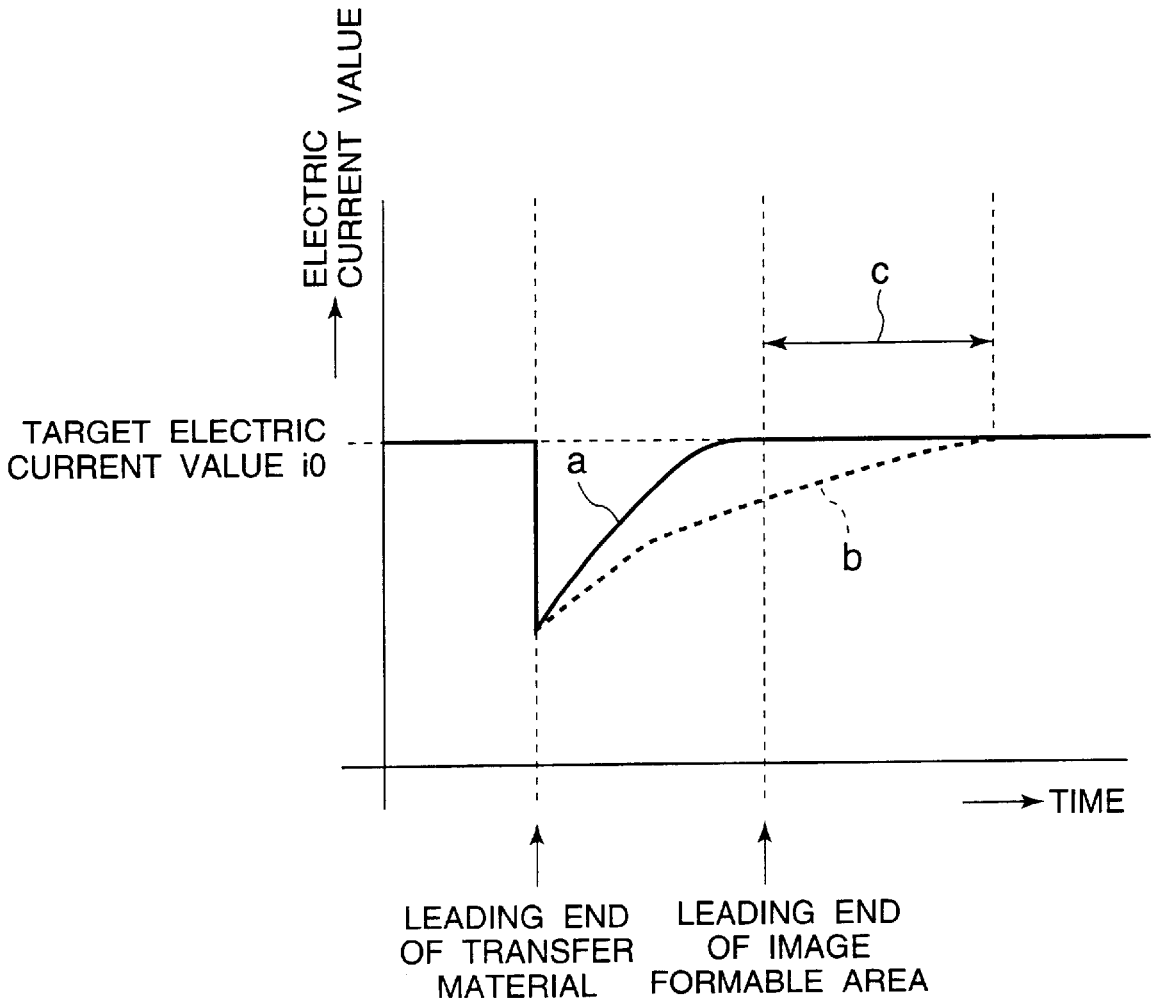
FIG. 6 is a view showing a waveform of a transfer electric current in the vicinity of the timing at which a leading end of the transfer material enters the secondary transfer position M.

FIGS. 5 and 6 are views showing a waveform of a transfer electric current in the vicinity of the timing at which the leading end of the paper sheet (transfer material P) enters the secondary transfer position M in the above-described experiment of comparison evaluation of levels of the "blank area caused by poor transfer". It is to be noted that FIG. 5 shows a waveform of a transfer electric current in the HH environment (high temperature and high humidity) and FIG. 6 shows a waveform of a transfer electric current in the LL (low temperature and low humidity) environment.

In regard to the waveform of the transfer electric current in image formation according to the present embodiment ("a" in FIGS. 5 and 6), the transfer electric current value rapidly converges on a target electric current value after the leading end of the paper sheet (transfer material P) enters the secondary transfer position M. On the contrary, as to the waveform of the transfer electric current in image formation in the comparative example ("b" in FIGS. 5 and 6), the transfer electric current waveform oscillates in the HH (high temperature and high humidity) environment in FIG. 5, the transfer electric current value slowly converges on a target electric current value in the LL (low temperature and low humidity) environment in FIG. 6, and both values take time to converge on the target electric current value.

That is because, in the HH (high temperature and high humidity) environment, the transfer impedance is lowered to facilitate flow of an electric current as the temperature and the humidity increase and the voltage variable quantity ΔV which is optimum in the JJ (ordinary temperature and ordinary humidity) environment is hence too large in the HH (high temperature and high humidity) environment. Therefore, when a sudden fluctuation of the load occurs due to plunge of the leading end of the paper sheet (transfer material P) into the transfer position, the applied electric current does not rapidly converge on the target electric current value but oscillates. Such an unstable state of the transfer bias causes the "black area caused by poor transfer" to be generated at the leading end of the paper sheet (transfer material P) in the HH (high temperature and high humidity) environment (range indicated by "c" in FIG. 5).

Moreover, in the LL (low temperature and low humidity) environment, the transfer impedance increases to make the electric current difficult to flow as the temperature and the humidity decrease, and the voltage variable quantity ΔV which is optimum in the JJ (ordinary temperature and ordinary humidity) environment is hence too small in the LL (low temperature and low humidity) environment. Therefore, when a sudden fluctuation of the load occurs at the leading end and the like of the paper sheet (transfer material P), the applied voltage takes time to converge on the target electric current value. As a result, the "blank area caused by poor transfer" occurs at the leading end of the paper sheet (transfer material P) in the LL (low temperature and low humidity) environment (range indicated by "c" in FIG. 6).

As described above, in this embodiment, even if the resistance of the paper sheet (transfer material P) or the resistance of the secondary transfer roller 14 is changed in the HH (high temperature and high humidity) environment or the LL (low temperature and low humidity) environment, the appropriate voltage can be constantly applied to the secondary transfer roller 14, and defective transfer can hence be reduced, thereby obtaining an excellent image.

Now, another example of the transfer electric current control in this embodiment will be described with reference to FIG. 7. This control is characterized in that the temperature and the humidity are successively detected in accordance with each detection of the electric current at the time of transfer control and the voltage quantity can be varied to a predetermined voltage quantity ΔV according to the detected temperature and humidity.

Figure 7:
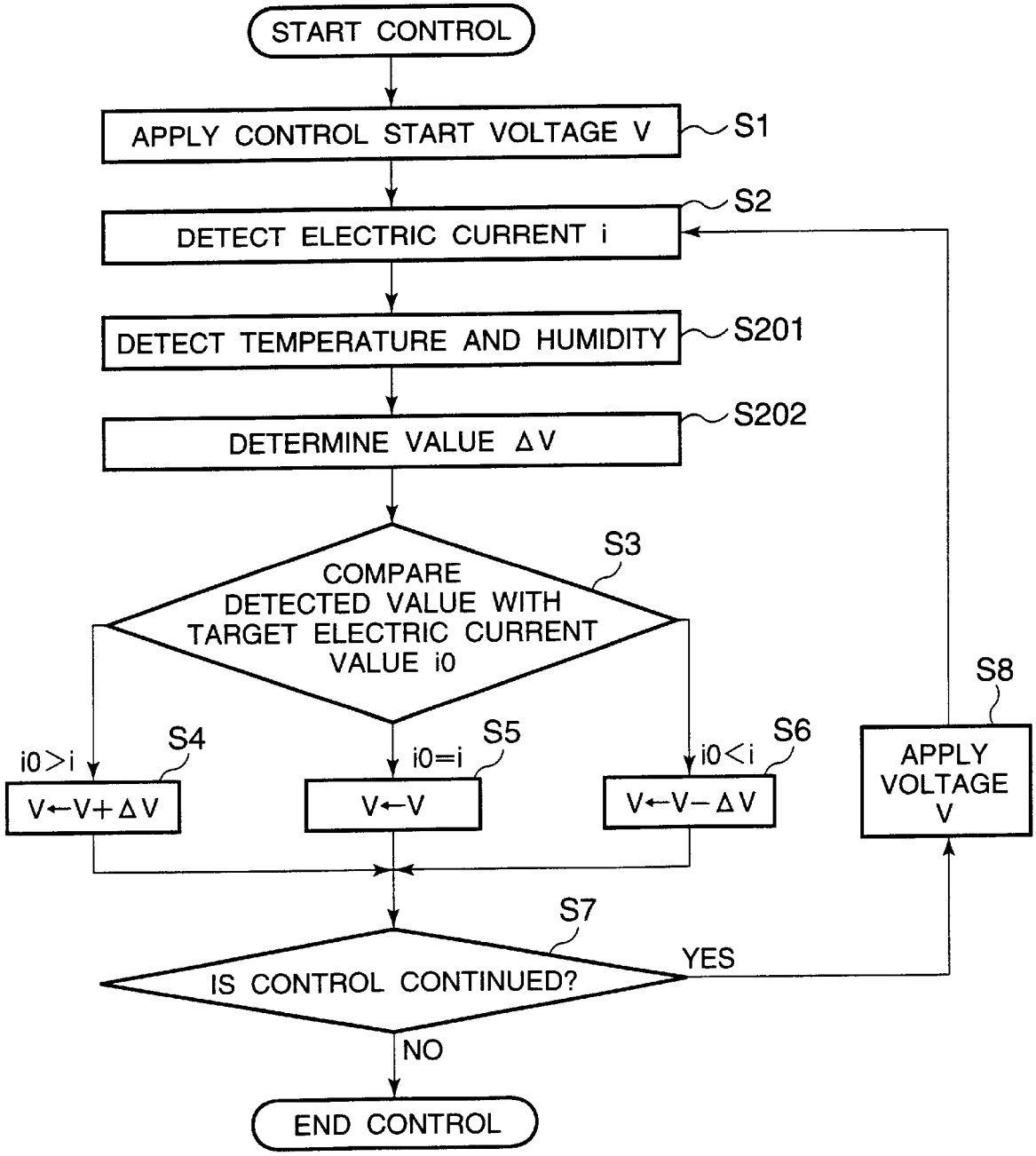
FIG. 7 is a flowchart of the transfer control according to another embodiment of the present invention.

As apparent from FIG. 7, a step for detecting the temperature and the humidity (S201) and a step for determining ΔV based on the temperature and humidity detection (S202) are included in a loop of the electric current detection control.

Figure 3:
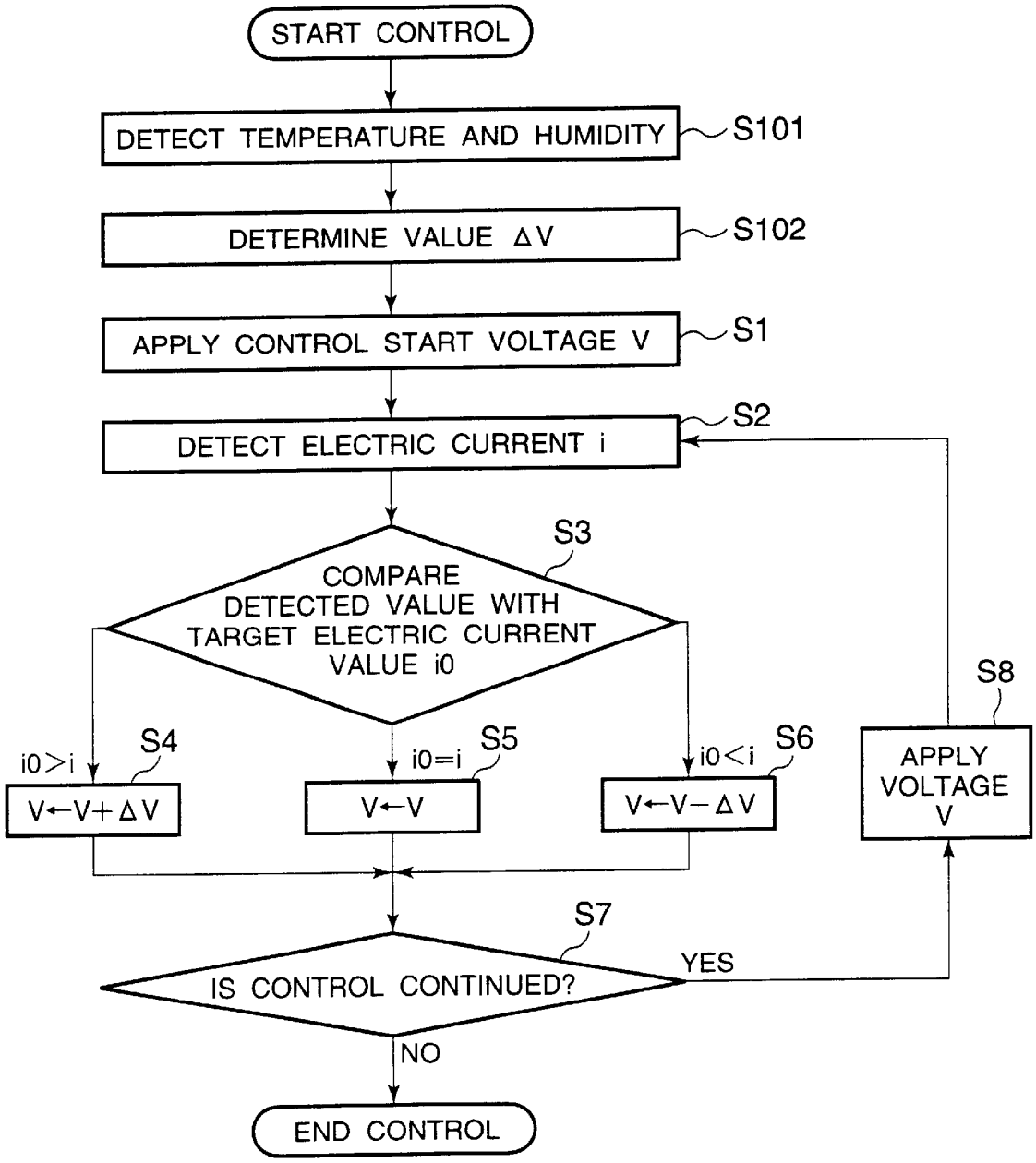
FIG. 3 is a flowchart of the transfer control according to the embodiment 1 of the present invention.

Steps S3 to S8 are similar to the steps S3 to S8 in FIG. 3.

Incidentally, although the table showing the relationship between the hygrothermal detection result and the voltage variable quantity ΔV is used in this embodiment, there is, e.g., a method for making a selection from a formula having a temperature and a humidity as parameters besides this table.

Figure 8:
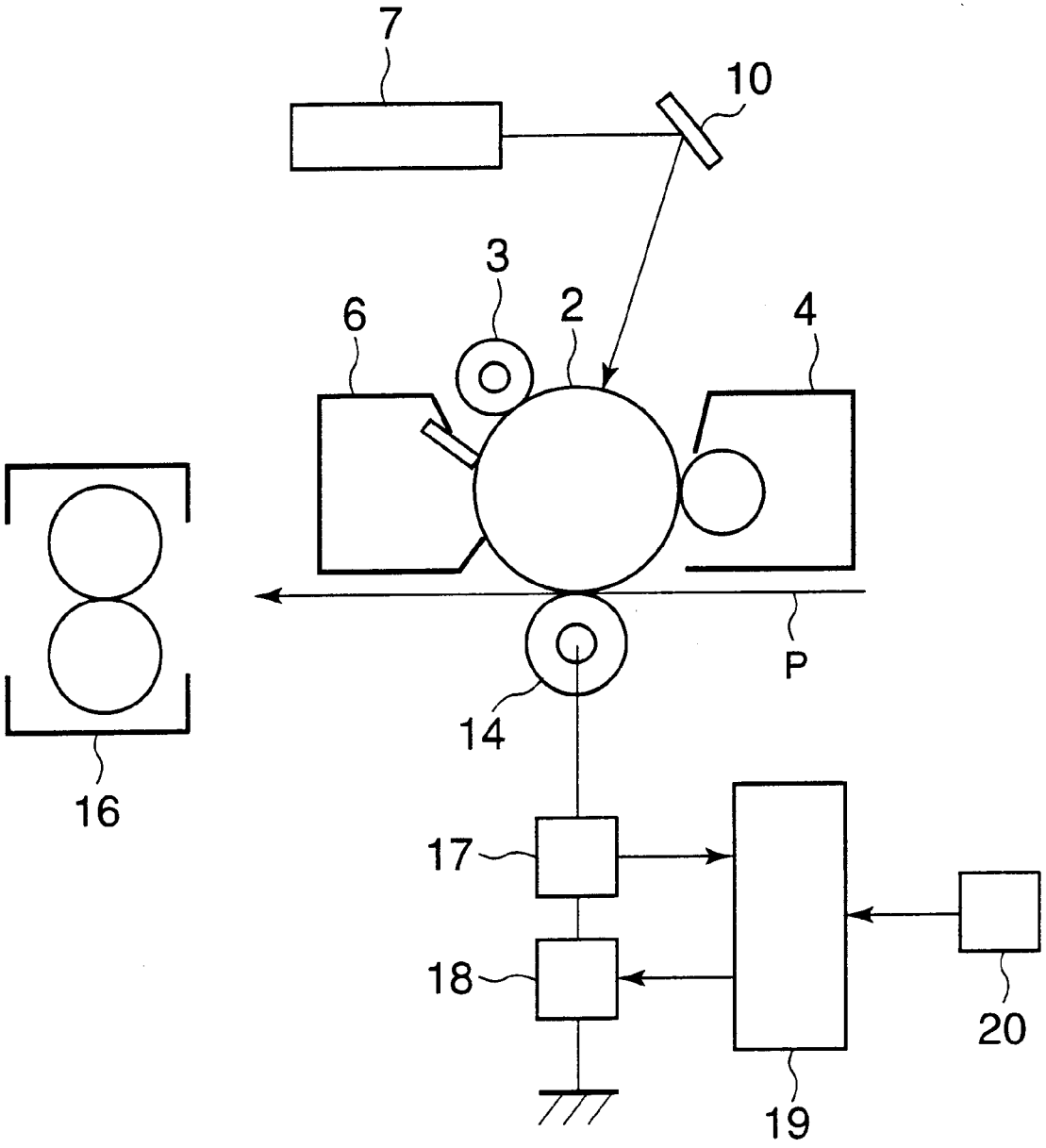
FIG. 8 is a schematic cross-sectional view showing an image forming apparatus according to still another embodiment of the present invention.

Furthermore, although the image forming apparatus of the intermediate transfer system using the intermediate transfer belt was described in this embodiment, the present invention can be applied to such an image forming apparatus as shown in FIG. 8 which transfers a toner image formed on the photosensitive drum 2 onto the transfer material P (paper) conveyed to between the photosensitive drum 2 and the transfer members 14 (for example, transfer rollers) which comes into contact with the photosensitive drum 2. In FIG. 8, like reference numerals denote structures which are the same as those in FIG. 1. It is to be noted that suffixes are omitted.

Embodiment 2

Although an appropriate voltage variable quantity ΔV is selected based on a result of temperature and humidity detection in the image forming apparatus in the above-described embodiment 1, the voltage variable quantity ΔV is changed based on a result of detection of the secondary transfer impedance in this embodiment as described below. In this embodiment, description will be given in conjunction with the conventional image forming apparatus shown in FIG. 11. It is to be noted that explanation which is tautological to the conventional art is omitted, and only the secondary transfer bias control in this embodiment will be described.

In the secondary transfer bias control in this embodiment, the electric current detector 17 detects an electric current which flows when a voltage is applied from the power supply 18 to the secondary transfer roller 14 by control of the controller 19 with the paper sheet (transfer material P) being held or not being held immediately before being held at the secondary transfer position M in which the secondary transfer roller 14 and the secondary transfer opposite roller 12 come into contact with the intermediate transfer belt 8 therebetween. Moreover, this detection signal is input to the controller 19, and the controller 19 obtains an electric current value i based on the input detection signal. In addition, the secondary transfer impedance Z1 with the paper sheet (transfer material P) being held or the secondary transfer impedance Z2 with the paper sheet (transfer material P) not being held is obtained from the applied voltage value V. The secondary transfer impedances Z1 and Z2 can be obtained based on Z1 or Z2 =V (applied voltage value)/i (electric current value).

Additionally, in this embodiment, an appropriate voltage variable quantity ΔV is selected based on the obtained secondary transfer impedance Z1 or Z2. Thus, in this embodiment, the relationship between the secondary transfer impedance Z1 and the appropriate voltage variable quantity ΔV was examined by an experiment, and this experimental result was expressed in the form of a table to be stored in a memory (not shown). Further, a value of the voltage variable quantity ΔV according to the obtained secondary transfer impedance Z1 was selected. FIG. 9 is a view showing the relationship between the secondary transfer impedance Z1 shown in the table and the voltage variable quantity ΔV in this embodiment.

Further, in this embodiment, the appropriate voltage variable quantity ΔV according to the secondary transfer impedance Z1 obtained as described above is selected from the table showing the relationship between the secondary transfer impedance Z1 and the voltage variable quantity ΔV, and a voltage V obtained by adding or subtracting the selected voltage variable quantity ΔV is applied to the secondary transfer roller 14 to execute the secondary transfer.

Figure 10:
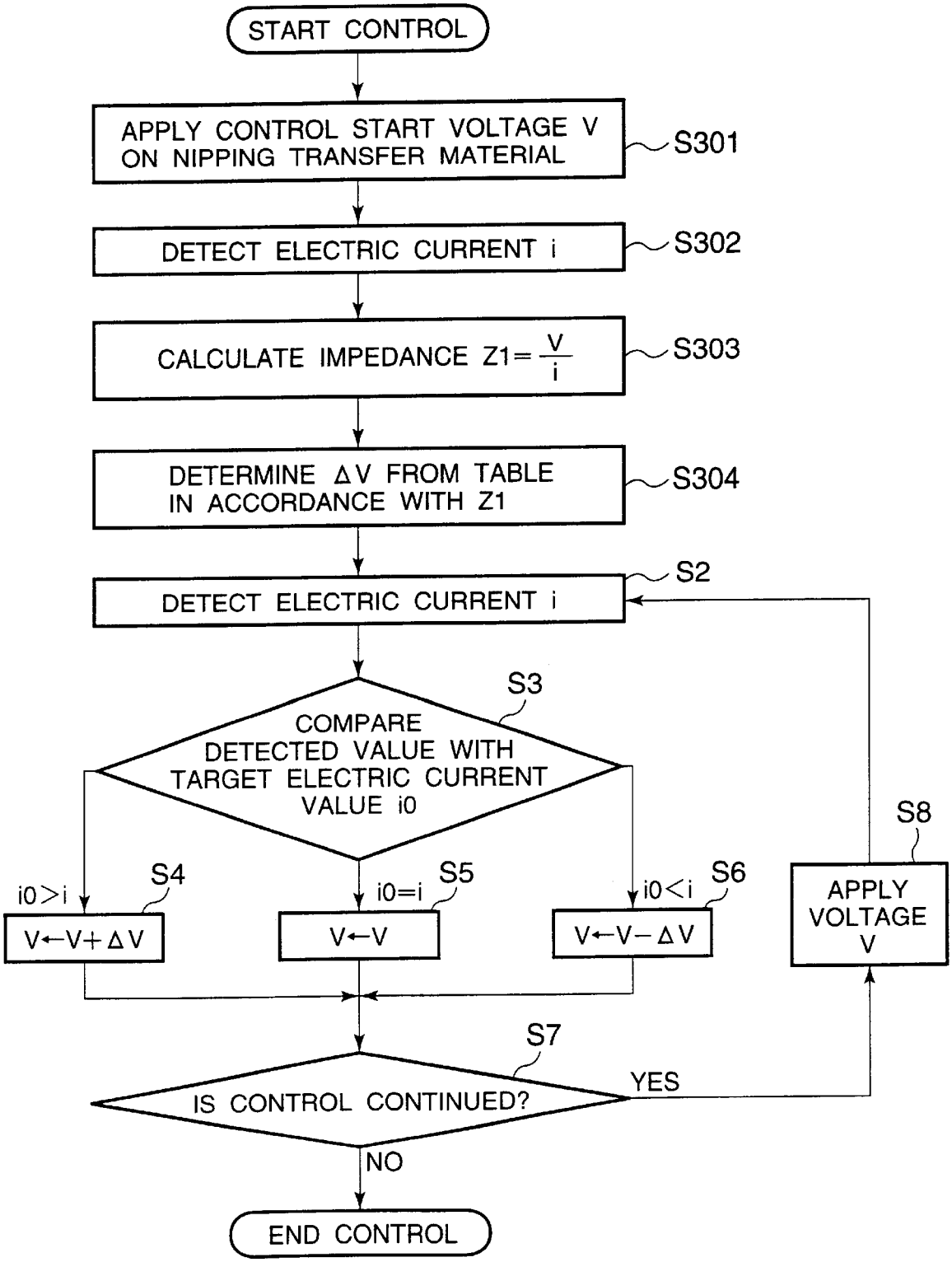
FIG. 10 is a flowchart of the transfer control according to the embodiment 2 of the present invention.

FIG. 10 is a flowchart showing the above-mentioned controlling operation. When the transfer material P is held, a control start voltage V is applied (S301), and an electric current i which flows at this time is detected (S302). Further, impedance Z1 is calculated based on the relationship between a value of this electric current i and the control start voltage V (S303), and the calculated impedance Z1 is associated with the table shown in FIG. 9 to determine a predetermined voltage quantity ΔV (S304). In S2 to S8, steps similar to S2 to S8 shown in FIG. 3 are executed.

It is to be noted that the flow similar to the above-described flow can be also executed when using the impedance Z2 when the transfer material is not held.

As described above, in this embodiment, even if the impedance of the transfer system such as the resistance of the paper sheet (transfer material P) or the resistance of the secondary transfer roller 14 is changed in the HH (high temperature and high humidity) environment or in the LL (low temperature and low humidity) environment, the appropriate voltage can be constantly applied to the secondary transfer roller 14, and defective transfer can be hence reduced, thereby obtaining an excellent image.

Incidentally, although the table showing the relationship between the secondary transfer impedance Z1 and the voltage variable quantity ΔV is used in this embodiment, there are, e.g., a method using a table showing the relationship between the secondary transfer impedance Z2 and the voltage variable quantity AV and a method for making a selection from a formula having the secondary impedance Z1 or Z2 or both secondary transfer impedance Z1 and Z2 as parameters besides this.

Further, the impedance Z1 or Z2 is obtained based on the start voltage V and the detection electric current i to determine a predetermined voltage quantity ΔV according to that impedance in the foregoing embodiment. However, if the start voltage V is fixed, a predetermined voltage quantity ΔV can be directly obtained from the detection electric current i by using a table or a formula in which the detection electric current i is associated with a predetermined voltage quantity.

Furthermore, although the image forming apparatus of the intermediate transfer system using the intermediate transfer belt was used in this embodiment, the present invention can be applied to an image forming apparatus which transfers a toner image formed on such a photosensitive drum 2 as shown in FIG. 8 onto the transfer material P (paper) conveyed to between the photosensitive drum 2 and the transfer members 14 (for example, the transfer rollers) which come into contact with the photosensitive drum 2. In FIG. 8, like reference numerals denote parts having the same structure as that in FIG. 1. It is to be noted that suffixes are omitted.

What is claimed is:

1. An image forming apparatus comprising:

an image bearing member for bearing a developer image;

transferring means for electrostatically transferring said developer image onto a transfer material;

a power supply for applying a voltage to said transferring means;

electric current detecting means for detecting a value of an electric current which flows to said transferring means when the voltage is applied from said power supply to said transferring means; and controlling means for controlling an output of said power supply by varying the voltage applied to said transferring means by a predetermined voltage quantity in such a manner that the value of the electric current detected by said electric current detecting means becomes a predetermined target electric current value, wherein the predetermined voltage quantity is variable, and impedance is calculated based on a value of the electric current when a predetermined voltage is applied to said transferring means and a value of the predetermined voltage, and the predetermined voltage quantity is determined based on the impedance.

2. An image forming apparatus comprising:

an image bearing member for bearing a developer image;

transferring means for electrostatically transferring said developer image onto a transfer material;

a power supply for applying a voltage to said transferring means;

electric current detecting means for detecting a value of an electric current which flows to said transferring means when the voltage is applied from said power supply to said transferring means;

temperature and humidity detecting means for detecting a temperature and a humidity; and controlling means for determining a predetermined voltage quantity based on temperature and humidity information detected by said temperature and humidity detecting means when controlling an output of said power supply by varying the voltage applied to said transferring means by said predetermined voltage quantity in such a manner that the value of the electric current detected by said electric current detecting means becomes a predetermined target electric current value.

3. The image forming apparatus according to claim 2, wherein said controlling means determines said predetermined voltage quantity by associating the detected temperature and humidity information with a table in which temperature and humidity values are associated with said predetermined voltage quantity.

4. The image forming apparatus according to claim 3, wherein said table is stored in storing means.

5. The image forming apparatus according to claim 2, wherein said controlling means determines said predetemined voltage quantity by associating the detected temperature and humidity information with a relational expression in which temperature and humidity values are associated with said predetermined voltage quantity.

6. The image forming apparatus according to claim 5, wherein said relational expression is stored in storing means.

7. The image forming apparatus according to any one of claims 2 to 6, wherein a value of the predetermined voltage quantity is decreased as a temperature detected by said temperature and humidity detecting means increases and as a humidity detected by said temperature and humidity detecting means increases.

8. The image forming apparatus according to claim 2, wherein said predetermined voltage quantity is determined in a time other than that of a transfer operation for transferring said developer image to said transfer material by said transferring means.

9. The image forming apparatus according to claim 8, wherein said predetermined voltage quantity is determined before starting said transfer operation.

10. The image forming apparatus according to claim 2, wherein said predetermined voltage quantity can be determined every time an electric current detection operation is carried out by said electric current detecting means.

11. An image forming apparatus comprising:

an image bearing member for bearing a developer image;

transferring means for electrostatically transferring said developer image onto a transfer material;

a power supply for applying a voltage to said transferring means;

electric current detecting means for detecting a value of an electric current which flows to said transferring means when the voltage is applied from said power supply to said transferring means; and controlling means for detecting by said electric current detecting means the value of the electric current which flows at a time of applying a predetermined voltage to said transferring means and determining a predetermined voltage quantity based on the value of the electric current at the time of applying the predetermined voltage before said transfer material reaches said transferring means while an output of said power supply is controlled by varying the voltage applied to said transferring means by the predetermined voltage quantity in such a manner that the value of the electric current detected by said electric current detecting means becomes a predetermined target electric current value, wherein impedance is calculated based on the value of the electric current when the predetermined voltage is applied and a value of the predetermined voltage and the predetermined voltage quantity is determined based on a value of a calculated impedance.

12. The image forming apparatus according to claim 11, wherein a value of the predetermined voltage quantity is decreased as the value of the calculated impedance decreases.

13. The image forming apparatus according to claim 11, wherein the predetermined voltage quantity is determined by associating the value of the calculated impedance with a table in which the impedance is associated with the predetermined voltage quantity.

14. The image forming apparatus according to claim 13, wherein said table is stored in storing means.

15. The image forming apparatus according to claim 11, wherein the predetermined voltage quantity is determined by assigning the value of the calculated impedance in a relational expression in which the impedance is associated with the predetermined voltage quantity.

16. The image forming apparatus according to claim 15, wherein said relational expression is stored in storing means.

17. The image forming apparatus according to claim 11, wherein a value of the predetermined voltage quantity is decreased as the value of the electric current at the time of applying said predetermined voltage increases.

18. An image forming apparatus comprising:

an image bearing member for bearing a developer image;

transferring means for electrostatically transferring said developer image onto a transfer material;

a power supply for applying a voltage to said transferring means;

electric current detecting means for detecting a value of an electric current which flows to said transferring means when the voltage is applied from said power supply to said transferring means; and controlling means for detecting by said electric current detecting means the value of the electric current which flows at a time of applying a predetermined voltage to said transferring means and determining a predetermined voltage quantity based on the value of the electric current at the time of applying the predetermined voltage when said transfer material reaches said transferring means while an output of said power supply is controlled by varying the voltage applied to said transferring means by the predetermined voltage quantity in such a manner that the value of the electric current detected by said electric current detecting means becomes a target electric current value, wherein impedance is calculated based on the value of the electric current at the time of applying the predetermined voltage and a value of the predetermined voltage and the predetermined voltage quantity is determined based on a value of a calculated impedance.

19. The image forming apparatus according to claim 18, wherein a value of the predetermined voltage quantity is decreased as the value of said calculated impedance decreases.

20. The image forming apparatus according to claim 18, wherein the predetermined voltage quantity is determined by associating the value of the calculated impedance with a table in which the impedance is associated with the predetermined voltage quantity.

21. The image forming apparatus according to claim 20, wherein said table is stored in storing means.

22. The image forming apparatus according to claim 18, wherein the predetermined voltage quantity is determined by assigning the value of the calculated impedance in a relational expression in which the impedance is associated with the predetermined voltage quantity.

23. The image forming apparatus according to claim 22, wherein said relational expression is stored in storing means.

24. The image forming apparatus according to claim 18, wherein a value of the predetermined voltage quantity is decreased as the value of the electric current at the time of applying the predetermined voltage increases.

* * * * *

UNITED STATES PATENT AND TRADEMARK OFFICE

CERTIFICATE OF CORRECTION

PATENT NO. : 6,498,907 B2 
DATED : December 24, 2002
INVENTOR(S) : Yasuo Yoda

It is certified that error appears in the above-identified patent and that said Letters Patent is hereby corrected as shown below:

Column 7,
Line 53, “of” blank” should read -- of “blank --, and “transfer ⇌ ” should read -- transfer” --.

Signed and Sealed this

Twenty-sixth Day of August, 2003

JAMES E. ROGAN
*Director of the United States Patent and Trademark Office*